US006477724B1

(12) United States Patent
Brunelle et al.

(10) Patent No.: US 6,477,724 B1
(45) Date of Patent: Nov. 12, 2002

(54) WATER EVACUATION CONDUIT FOR HYDRO MASSAGING TUB

(75) Inventors: Henry Brunelle, Cap Rouge (CA); Stéphane Baron, Charny (CA); Guy Baillargeon, St. Lambert (CA)

(73) Assignee: Gestion Ultra International Inc., Québec (CA)

( * ) Notice: Subject to any disclaimer, the term of this patent is extended or adjusted under 35 U.S.C. 154(b) by 0 days.

(21) Appl. No.: 10/086,706

(22) Filed: Mar. 4, 2002

(51) Int. Cl.[7] ..... A61H 33/06; A61H 33/00
(52) U.S. Cl. ..... 4/541.5; 4/541.1
(58) Field of Search ..... 4/541.1–541.6, 4/567–569, 492

(56) References Cited

U.S. PATENT DOCUMENTS 3,251,071 A * 5/1966 Wood
3,467,969 A * 9/1969 Szekely
4,249,522 A * 2/1981 Carrier
4,901,379 A * 2/1990 Chalberg et al.
5,307,529 A * 5/1994 Wang
5,383,239 A * 1/1995 Mathis et al.
5,930,851 A * 8/1999 Brunelle
6,279,177 B1 * 8/2001 Gloodt
6,357,060 B2 * 3/2002 Gloodt

* cited by examiner

*Primary Examiner*—Charles R. Eloshway
(74) *Attorney, Agent, or Firm*—Swabey Ogilvy Renault; Guy J. Houle

(57) ABSTRACT

A hydro massage bathtub enclosure is provided with conduits interconnecting air jet holes provided in the sidewalls, end or bottom wall of the bathtub enclosure. One or more curved cavities are disposed below one or more of the air jet holes to create a turbulent air flow in the area of the curved cavity whereby to expel any residual water accumulated in the curved cavity after the water level in the bathtub enclosure has been lowered below the air jet holes with the conduit pressurized by air from the blower to purge the conduit. A water evacuating conduit may also be connected in such cavities for the evacuation of residual water therefrom.

20 Claims, 4 Drawing Sheets

WATER EVACUATION CONDUIT FOR HYDRO MASSAGING TUB

TECHNICAL FIELD

The present invention relates to a hydro massage bathtub enclosure and more specifically to air communication conduits which interconnect air jet holes and/or valves disposed in the walls of the bathtub enclosure to a blower which directs pressurized air to the air jet holes via the conduits.

BACKGROUND ART

Hydro massage bathtub enclosures provided with air jet holes and/or valves and conduits to direct air under pressure into the bathtub to impart turbulent massage air flows in the water, are known. After the water in the bathtub enclosure has been evacuated it is desirable to actuate the air blower whereby to purge the conduits of any residual water or water droplets that could have infiltrated into the conduit through the holes and this particularly when the air blower is shut off while water remains in the bathtub enclosure. Usually, to evacuate this residual water the blower is actuated a predetermined time after the water has been evacuated from the bathtub enclosure. However, it has been found that water may still remain in the conduit in specific areas thereof where air pressure is reduced or where a stagnant area is created in the conduit due to its shape and/or the location of air jet holes with respect to the stagnant areas. Stagnant water in the conduit is not desirable as it generates bacteria.

SUMMARY OF INVENTION

It is a feature of the present invention to provide a hydro massage bathtub enclosure having conduit means which substantially overcomes the above-mentioned disadvantage of the prior art.

According to another feature of the present invention, there is provided a hydro massage bathtub enclosure wherein the conduit means is provided with a curved cavity below one or more of the air jet holes to create a turbulent air flow in the area of the curved cavity to evacuate any residual water in the conduit through an associated air jet hole.

Another feature of the invention is to provide an air conduit which has a sloped bottom wall to substantially compensate for pressure drop and to facilitate residual water evacuation therefrom.

Another feature of the invention is to provide an air conduit which is tapered.

According to a further feature there is provided an air jet hole in the cavity for the evacuation of water in the cavity through the jet hole or valve secured thereto.

According to the above features, from a broad aspect, the present invention provides a hydro massage tub which comprises sidewalls, end walls and a bottom wall, and an open top end. A plurality of air jet holes is provided in at least some of the sidewalls, end walls and bottom wall. Conduits interconnect the air jet holes to an air blower, which provides air pressure in the conduit. The improvement resides in one or more cavities having been formed in the conduits adjacent one or more of the air jet holes to collect residual water channeled in the one or more cavities after the water level in the bathtub enclosure has been lowered below the air jet holes. The air pressure in the conduit evacuates the water from the cavity through an associated one of the air jet holes.

According to a further broad aspect of the present invention, the cavity is a curved cavity whereby the air pressure in the conduit creates a turbulent air flow in the curved cavity to disperse residual water channeled to the cavity through the air jet hole.

According to a still further broad aspect of the present invention, there is further provided a water evacuating conduit secured in the conduit means and having an inlet end disposed adjacent the base wall of the cavity and a discharge end is secured about the air jet hole, whereby the air pressure in the conduit means will force the residual water from the cavity through the evacuating conduit and out through the air jet hole.

BRIEF DESCRIPTION OF DRAWINGS

A preferred embodiments of the present invention will now be described with reference to the accompanying drawings in which.

DESCRIPTION OF PREFERRED EMBODIMENTS

Figure 1:
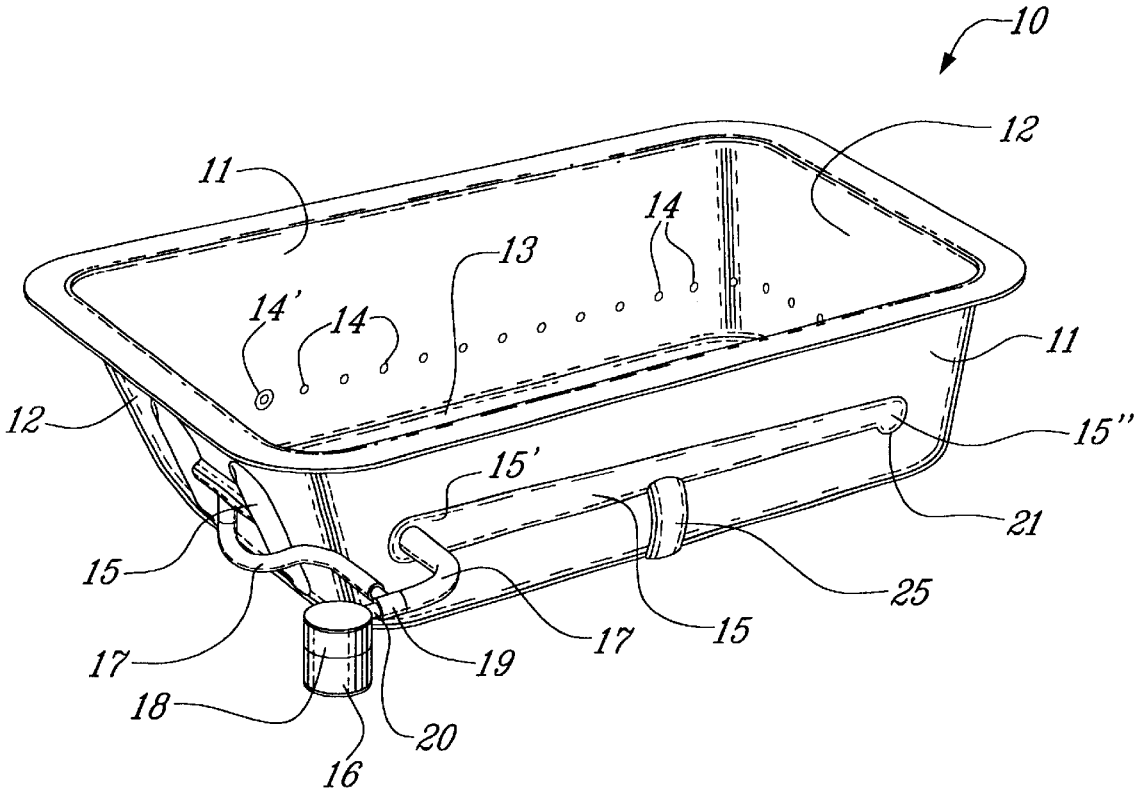
FIG. 1 is a simplified perspective view of a hydro massage bathtub enclosure provided with air jet holes which may be provided with valves, and conduits to deliver air under pressure through the air jet holes and/or valves.

Referring now to the drawings and more particularly to FIG. 1, there is shown generally at 10 a hydro massage bathtub defined by sidewalls 11, end walls 12 and a bottom wall 13. The bathtub enclosure has an open top end to provide access to a bather. As hereinshown a plurality of air jet holes 14 are formed in the sidewalls 11, end walls 12 and bottom wall 13 whereby to create massaging streams of air bubbles within the bathtub enclosure when the tub is filled with water. Some of the air jet holes 14 may be provided with valves 14' as is well known in the art.

Figure 2:
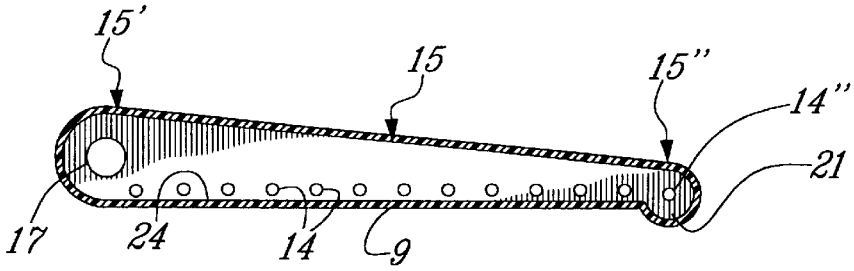
FIG. 2 is a simplified section view showing the shape of a conduit,and associated air jet holes.
Figure 3:
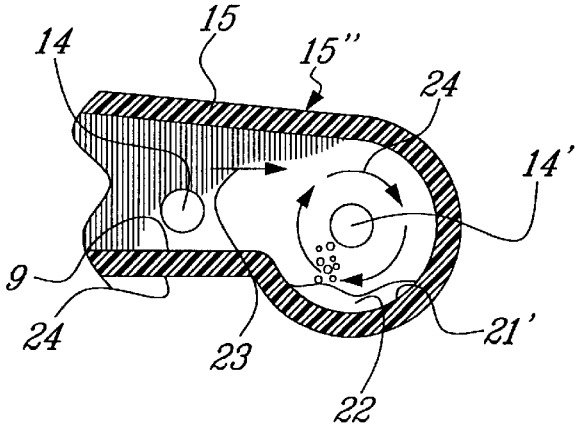
FIG. 3 is a section view of a small end of a tapered conduit showing the curved cavity and its associated air jet hole.

Referring now additionally to FIGS. 2 and 3, air connecting conduits 15, formed of molded styrene or other suitable materials, are attached to the sidewalls, end walls, and bottom wall by fiberglass coatings or fiberglass spray and are associated with groups of a plurality of the air jet holes 14 and/or valves 14' connected thereto whereby to direct air under pressure into the bathtub 10. As hereinshown a blower 16 is provided with connection pipes 17 to connect to the various groups of conduits 15. The hydro massage bathtub 10 as hereinshown is a hydro-thermo massage tub and is therefore provided with a heater 18 associated with the blower 16 whereby to warm the air prior to being convected in the conduits 15. A valve 19 is provided at the outlet coupling 20 of the blower and heater combination and is actuatable by remote switches (not shown) whereby to select individual ones or all of said groups of air jet holes 14 and/or valves 14' and consequently select a particular hydro massage, as is well known in the art.

As above described, it is important once the water is evacuated from the bathtub enclosure 10 to purge these conduits 15 with air under pressure from the blower 16 whereby to evacuate any residual water or water droplets that may have accumulated in these conduits to prevent bacteria from forming therein. In order to effectively do so, the conduits 15 are shaped with a curved cavity 21 formed below at least one air jet hole 14. This cavity 21 is formed at a far end of the conduit in a base wall 9 of the conduit and adjacent to an end one 14" of the air jet holes 14 associated with the conduit whereby any residual water 22 is accumulated in this cavity due to the air flow within the conduit 15 as air is directed to the cavity along the conduit in the direction of arrow 23, air in the area of the cavity will start to cyclone within the cavity 21 due to the curvature thereof creating air turbulence, as indicated by arrows 24, whereby to expel the residual water 22 through the air jet hole 14" associated therewith. Accordingly, this curvature of the cavity not only accumulates residual water but provides for its evacuation by creating a turbulent air flow in the area of its associated air jet hole 14" whereby to disperse the residual water in tiny water droplets and evacuate same through the hole 14". It is pointed out that the curved cavities 21 may have various curved shapes to facilitate residual water trapping and evacuation. As well, some of the air jet holes may have a different shape for the evacuation of residual water.

As shown in FIG. 2, the conduits 15 may be tapered whereby the bottom wall thereof is sloped to facilitate residual water flow to the end cavity 21. The taper also substantially compensates for pressure drop along the conduit caused by the varying distance of the holes from the blower 16. The taper substantially equalizes air pressure throughout the conduit.

As shown, the connecting pipe 17 of the blower 16 is connected adjacent the large end 15' of the conduit 15 and the curved cavity is disposed adjacent the small end 15" thereof below the air jet hole 14". The air jet hole 14" is spaced substantially equidistant from the arcuate inner surface 21' above the curved cavity. It is also pointed out that these channels are formed with a very smooth inner surface throughout to facilitate air flow and the purging of any residual water that may accumulate therein. The smooth surface also eliminates irregularities in which water droplets could collect.

It is pointed out that the conduit does not have to be tapered and cavities 21 may be disposed under any of the air jet holes or all of them and therefore not necessarily only the end one although this appears to the preferred embodiment.

Figure 4:
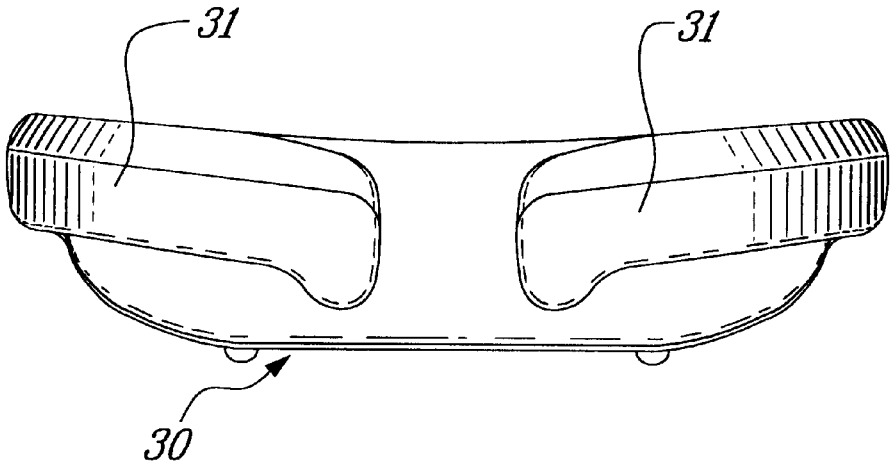
FIG. 4 is an end view of a formed, bottom shell containing channels to be secured by fiberglass matting or spray to a bathtub.
Figure 5:
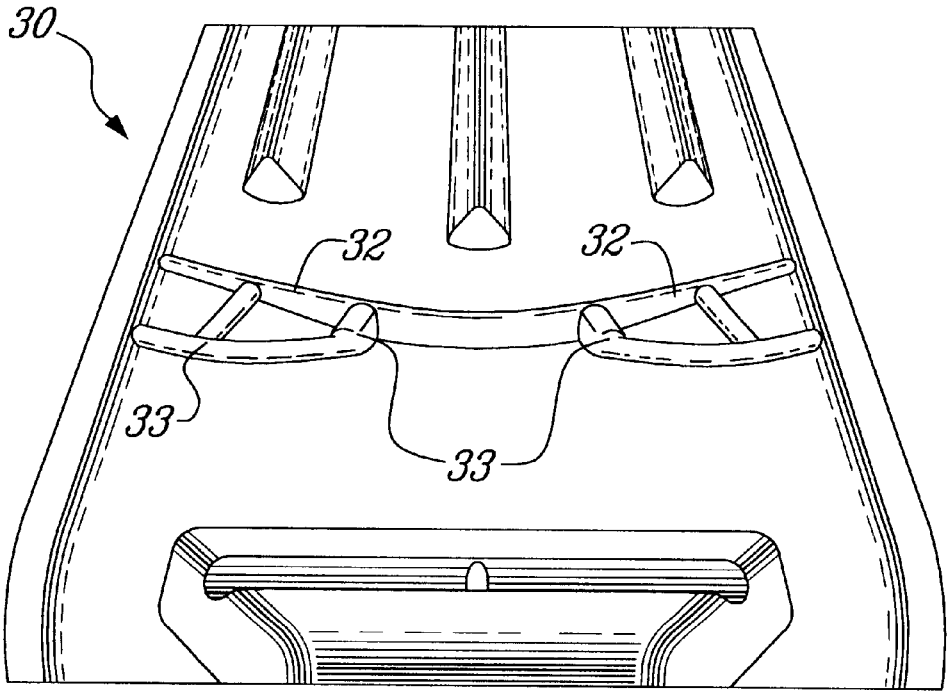
FIG. 5 is a bottom view of FIG. 4 showing the channels located under the bottom wall of a bathtub.

Referring to FIGS. 4 and 5 there is shown a bottom shell 30 which is formed with air distribution channels. In FIG. 4 the channels 31 are curved to form air channels which extend from opposed sides of an end wall 12 of the bathtub enclosure. In FIG. 5 there is shown the bottom wall of the shell with channels 32 which form branch channels such as the branch channel 25 illustrated in FIG. 1 interconnecting a main channel to air jets 14 disposed in the bottom wall 13 as shown in FIG. 1. As hereinshown the bottom wall 13 would be provided with four air jet holes two to each side of the bottom wall with a cavity 21 being formed under each of the holes by the channels 33 in the shell 30. These curved cavities would trap any residual water or water droplets and the air flow through the conduits would cause turbulence adjacent the air jet holes to expel water collected in the cavities. The shells as shown in FIGS. 4 to 5 are provided with smoothly curved cavities 21 and these cavities 21 are sprayed with a smooth acrylic finish to provide a sanitary slippery surface to enhance air flow and to prevent water accumulating or being trapped in the channels by imperfect inner surfaces of the conduits as above mentioned.

As shown in FIG. 2 the bottom wall 24 of the conduit 15 is sloped from its large end 15' to its small end 15" whereby to facilitate the propagation of water to the end cavity 21 for residual water evacuation, as above described.

Figure 6:
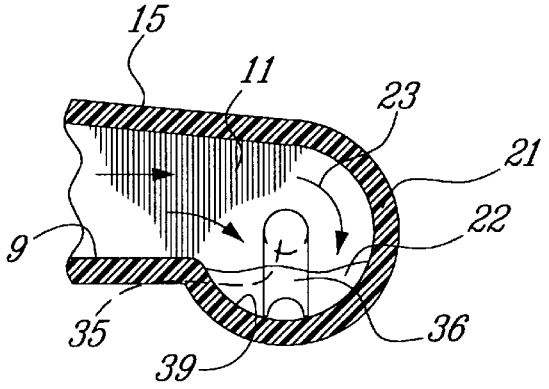
FIG. 6 is a section view similar to FIG. 3 but wherein a water evacuating conduit is secured in the cavity and about the water evacuating hole to evacuate residual water from the cavity.
Figure 7:
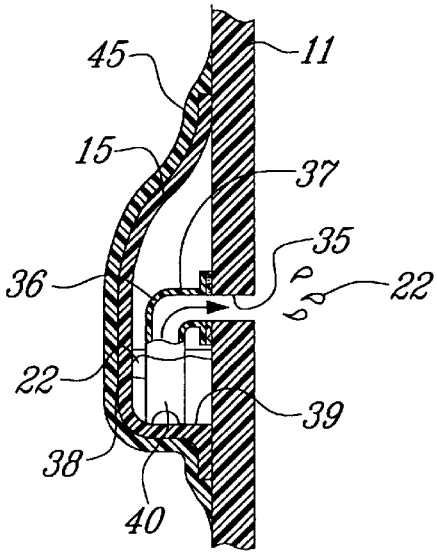
FIG. 7 is a side section view of the pressure conduit and the cavity with the water evacuation conduit.
Figure 8:
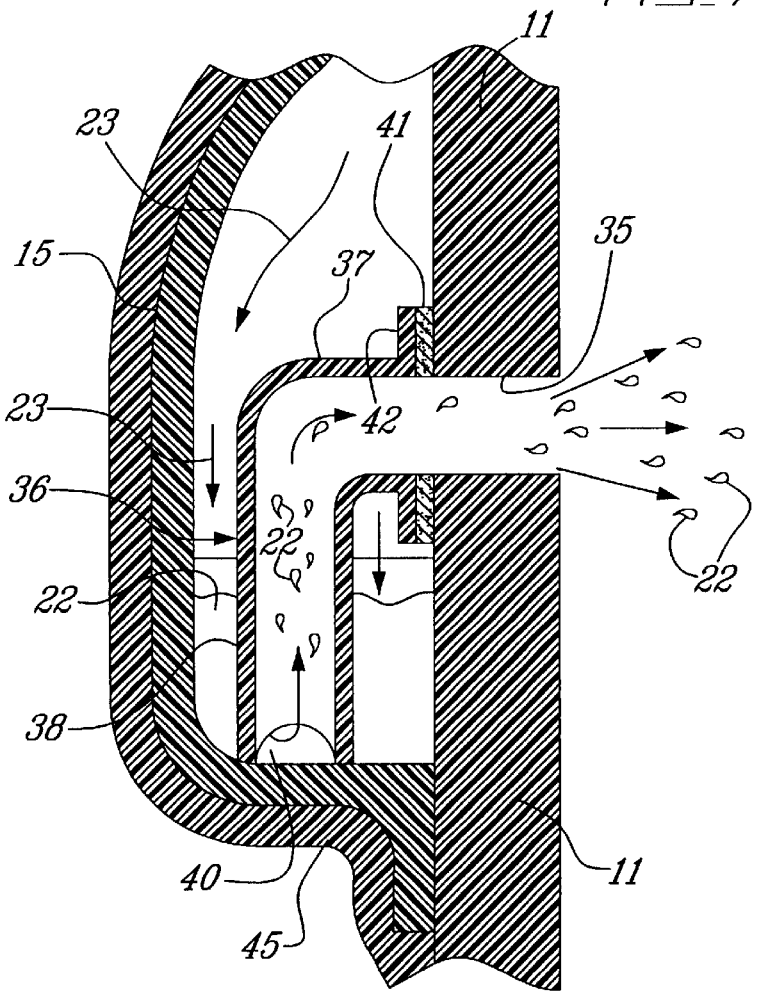
FIG. 8 is an enlarged section view, partly fragmented, of the water evacuation conduit and the cavity.

With reference now to FIGS. 6 to 8, there is shown another embodiment for evacuating the residual water 22 that collects at the bottom of the curved cavity 21 at the end of the tapered channel 15. As herein shown, an evacuation hole 35, which is an air jet hole, is formed in the sidewall 11 of the bathtub at a specific location with respect to the curved cavity 21. An evacuation conduit 36, herein shown as a right angle conduit, has a neck portion 37, the end of which is secured about the hole 35 by a suitable glue 41 or other securement means, and a depending portion 38 extends to the base 39 of the curved cavity 21. The end portion of the neck 37 may also be flanged, as shown at 42 to facilitate securement. The lower end of the depending portion 38 has an arcuate shaped out portion whereby to define an inlet port 40. Alternatively, the lower end of the depending portion may be a straight end but spaced closely above the base 39 or the curved cavity 21. As the residual water 22 is pushed into the curved cavity 21 by the air flow pressure in the direction of arrow 23 the air will be directed to the base of the cavity by the location of the inlet 40 adjacent the base and this air flow will sweep the base and cause the residual water 22 to flow through the inlet port 40 of the evacuation conduit 36 with the air flow and out through the evacuating hole 35. Accordingly, all of the residual water and water droplets are evacuated from the curved cavity 31 through the evacuation conduit 36 and the hole 35. The conduit 15 is hereinshown attached to the outer side wall of a bathtub by a fiberglass coating 45. The conduits may also have a variety of shapes and many small conduits may feed from a main conduit.

Figure 9:
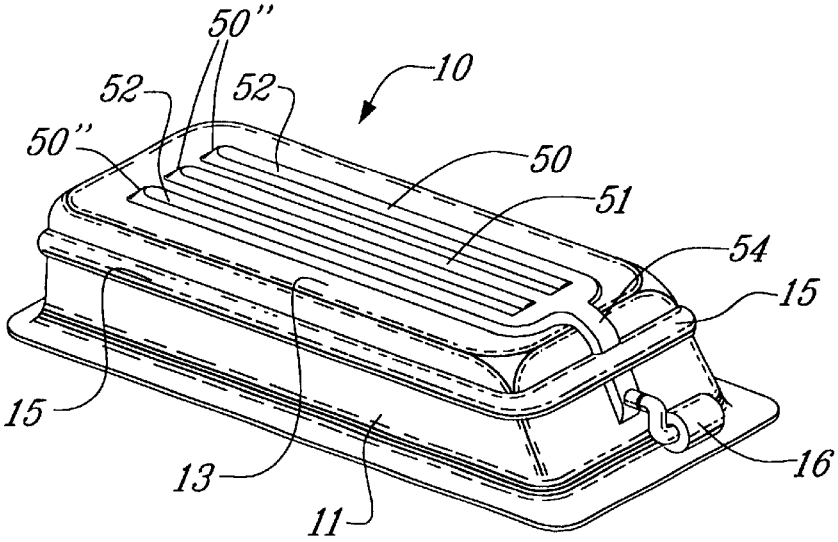
FIG. 9 is a bottom view of a hydro massage tub provided with bottom distribution conduits secured to the tub by fiberglass matting or fiberglass spray.
Figure 10:
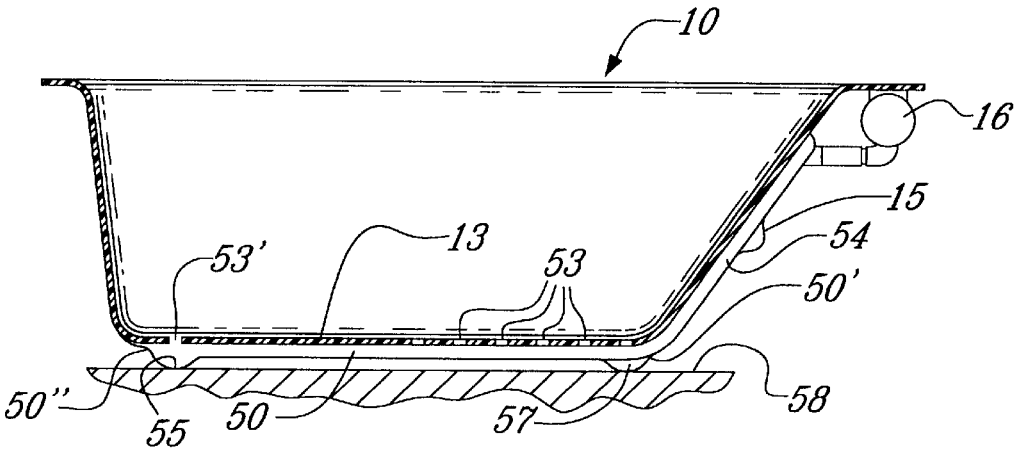
FIG. 10 is a simplified sectional side view of the tub and one of the bottom conduits but equipped with an air evacuating cavity.
Figure 11:
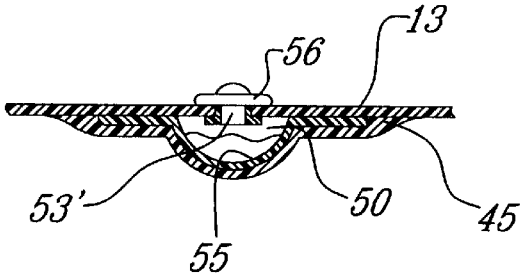
FIG. 11 is an enlarged section view of the bottom channel and air evacuating cavity provided with the water evacuation conduit and wherein the air jet hole is equipped with a valve.

Referring now to FIGS. 9, 10 and 11 there is shown another embodiment of the bathtub enclosure 10 and as hereinshown one or more, herein three, molded air conduits 50, 51 and 52 are secured to the bottom wall 13 of the bathtub 10 and attached thereto by fiberglass coatings or spray as above described. These molded air conduits 50, 51 and 52 are also provided with a plurality of air jet holes (53) strategically disposed therealong in the bottom wall 13 of the bathtub whereby to provide a hydro massage flow when water is disposed within the bathtub. The bottom molded air conduits 50, 51 and 52 also connect to the air blower motor 16 via an interconnecting duct 54. This duct may also be connected to the other channels 15 strategically disposed about the bathtub side walls and end walls. The conduits 50, 51 and 52 may also taper from their inlet end 50' to their terminal end 50". These bottom conduits may also serve as support rail to maintain the bathtub elevated from a support surface.

As clearly illustrated in FIGS. 10 and 11 the terminal ends 50" of the conduit 50 and also of the other conduits 51 and 52 are provided with a cavity 55 which is the same as the cavity 21 as previously described. As strategically located with respect to one of the jet holes herein jet hole 53' which constitutes a residual water evacuation hole.

As shown in FIG. 11 the jet hole or water evacuation hole 53' may also be provided with an air direction valve 56 as is well known in the construction of hydro massage bathtubs. These terminal end cavities may also be provided with a water evacuating conduit 36 as earlier described with respect to FIGS. 6–8. A transverse rib 57 may also be attached across the conduits 50, 51 and 52 and co-act with the molded conduits which are reinforced with fiberglass coatings whereby to constitute reinforced support ribs for the bottom wall 13 of the bathtub whereby to support the bathtub on a support surface 58 in a substantially horizontal plane.

It is also not known to integrate molded air channels with the bottom wall of the bathtub. Usually, air is supplied to air jets or valves in the bottom wall by flexible conduits. This necessitates the construction of supports under the tub and cause problems in repairs if conduit leak under the tub.

It is within the ambit of the present invention to cover any obvious modifications of the preferred embodiment described herein provided such modifications fall within the scope of the appended claims.

What is claimed is:

1. In a hydro massage bathtub comprising sidewalls, end walls and a bottom wall and an open top end, a plurality of air jet holes in at least some of said sidewalls, end walls and bottom wall; conduits interconnecting said air jet holes to an air blower, said air blower providing air pressure in said conduits, the improvement comprising one or more cavities formed in said conduit adjacent one or more of said air jet holes being sized and shaped to collect residual water channeled in said one or more cavities after the water level in said bathtub enclosure has been lowered below said air jet holes and to circulate said air pressure in said conduit within said cavity to thereby disperse and evacuate said water from said cavity through an associated one of said air jet holes.

2. A hydro massaging bathtub as claimed in claim 1 wherein said cavities are curved cavities disposed below its associated one of said air jet holes whereby said air pressure in said conduit creates a turbulent air flow in said curved cavity to disperse residual water channeled to said cavity through said water evacuating hole.

3. A hydro massage bathtub enclosure as claimed in claim 2 wherein said conduit means is one or more molded conduits each associated with a group of said plurality of air jet holes.

4. A hydro massage bathtub enclosure as claimed in claim 3 wherein said conduit means is one or more tapered conduits, said air blower being connected to said one or more tapered conduits adjacent a large end of said tapered conduits.

5. A hydro massage bathtub enclosure as claimed in claim 4 wherein said curved cavity is formed in said base wall of said tapered conduits adjacent a small end thereof below an air jet hole with said air jet hole being spaced substantially equidistant from an arcuate inner surface of said curved cavity.

6. A hydro massage bathtub enclosure as claimed in claim 5 wherein said base wall of said tapered conduit is a sloped base wall whereby to facilitate residual water flow toward said small end of said tapered conduit for collection in said curved cavity and evacuation therefrom through said air jet hole.

7. A hydro massage bathtub enclosure as claimed in claim 5 wherein said tapered conduit substantially equilibrates air pressure therein due to its reducing volume between said large and small ends of said conduit.

8. A hydro massaging bathtub as claimed in claim 3 wherein there is further provided two or more bottom molded air conduits under said bottom wall of said bathtub, some of said air jet holes being associated with said bottom molded air conduits, therebeing one of said curved cavity at each terminal end of said bottom molded air conduits.

9. A hydro massaging bathtub as claimed in claim 8 wherein air direction valves are secured to said air jet hole adjacent said cavity at said terminal end of said bottom molded air conduits.

10. A hydro massaging bathtub as claimed in claim 9 wherein said bottom molded air conduits also constitute reinforced support ribs for said bathtub.

11. A hydro massage bathtub enclosure as claimed in claim 2 wherein said conduit means are molded conduits having a smooth inner surface, said conduits being attached to said at least some of said sidewalls, end walls and bottom wall by a fiberglass coating adhering to said bathtub.

12. A hydro massaging bathtub as claimed in claim 1 wherein said one or more cavities is a single cavity disposed adjacent a far end one of said air jet holes.

13. A hydro massage bathtub enclosure as claimed in claim 1 wherein said bathtub enclosure is a hydro-thermo massage bathtub enclosure, and an air heater associated with said blower.

14. A hydro massaging bathtub as claimed in claim 1 wherein there is further provided a water evacuating conduit having an inlet end disposed adjacent said base wall of said cavity and a discharge end secured about said water evacuating hole whereby said air pressure in said conduit means will be directed against said base wall in said cavity to force said residual water collecting in said cavity through said inlet end of said evacuating conduit and out through said water evacuating hole.

15. A hydro massaging bathtub as claimed in claim 14 wherein said inlet end is provided with an inlet port.

16. A hydro massaging bathtub as claimed in claim 15 wherein said inlet port is arcuately shaped to form opposed inlet ports adjacent said base wall, said inlet end of said water evacuating conduit abutting said base wall.

17. A hydro massaging bathtub as claimed in claim 14 wherein said inlet port is constituted by said inlet end disposed spaced closely to said base wall of said cavity.

18. A hydro massage bathtub comprising sidewalls, end walls, a bottom wall and an open top end; one or more bottom conduits in at least said bottom wall, air jet holes in said bottom wall in communication with said conduits, said bottom conduits being secured under said bottom wall on an outer surface thereof by securement means and forming longitudinal ridges on said outer surface, an air blower connected to a distribution conduit which is connected to said bottom conduits to provide air pressure wherein to exit through said air jet holes and into a volume of water in said bathtub to produce massaging flows; and one or more cavities provided in a wall of each said bottom conduit facing respective ones of said air jet holes to create a turbulent air flow in said cavities adjacent said respective ones of said air jet holes to disperse residual water channeled in said cavity through said respective ones of said air jet holes after said volume of water has been drained from said bathtub.

19. A hydro massaging bathtub as claimed in claim 18 wherein said securement means is a fiberglass matting or a fiberglass spray attaching said bottom conduits on said outer surface of said bottom wall.

20. A hydro massaging bathtub as claimed in claim 19 wherein said bottom conduits constitute elongated support rails to maintain said bottom wall of said bathtub elevated over a support surface.

* * * * *